US005439347A

United States Patent [19]

Brandon

[11] Patent Number: 5,439,347

[45] Date of Patent: Aug. 8, 1995

[54] TURBINE TIP SEAL DAMAGE PROTECTION MEANS

[76] Inventor: Ronald E. Brandon, 652 Jubilee St., Melbourne, Fla. 32940

[21] Appl. No.: 298,595

[22] Filed: Aug. 31, 1994

[51] Int. Cl.[6] ..... F01D 11/08

[52] U.S. Cl. ..... 415/121.2; 415/173.5; 415/173.7; 277/53

[58] Field of Search ..... 415/173.5, 173.6, 173.7, 415/174.5, 121.2; 277/53

[56] References Cited

U.S. PATENT DOCUMENTS

| | | | |
|---|---|---|---|
| 4,273,510 | 6/1981 | Ambrosch et al. | 415/173.6 |
| 4,979,755 | 12/1990 | Lebreton | 415/174.5 |
| 5,271,712 | 12/1993 | Brandon | 415/173.7 |

FOREIGN PATENT DOCUMENTS

| | | | |
|---|---|---|---|
| 122002 | 10/1978 | Japan | 415/173.6 |
| 143104 | 8/1983 | Japan | 415/174.5 |
| 505 | 1/1984 | Japan | 415/174.5 |

*Primary Examiner*—Edward K. Look
*Assistant Examiner*—James A. Larson
*Attorney, Agent, or Firm*—Ross, Ross & Flavin

[57] ABSTRACT

In a steam or gas turbine employing tip seals which are disposed between a stationary shell or spill strip holder and a rotating bucket cover or shroud to minimize steam leakage, the improvement for limiting particle damage to the tip seals and adjacent components comprising: a scoop plate mounted on the shell or spill strip holder from which the tip seals depend, circumferential openings in the tip seals, and expulsion scoops on the scoop plate adjacent the tip seals for deflecting particulate material through the circumferential openings in the tip seals for minimizing damage thereto.

5 Claims, 1 Drawing Sheet

TURBINE TIP SEAL DAMAGE PROTECTION MEANS

BACKGROUND OF THE INVENTION

1. Field of the Invention

This invention relates to radial seals such as tip seals employed in rotating turbine machinery and disposed between stationary and rotating parts.

2. Description of the Prior Art

Radial seals can become deteriorated due to the presence of particulate material that enters the turbine and is flung into the area containing the tip seals where it cannot escape, then batters and erodes the tip seals, bucket covers and adjacent stationary parts.

A persistent and costly problem for steam and gas turbines using radial tip seals to minimize leakage over the shrouds or bucket covers of the turbine stages is the damage caused by particles. The particles can be either broken pieces of the turbine or foreign particles that enter the turbine with the steam. These particles, once having reached the location of the tip seals, have great difficulty escaping and are generally forced to circulate at great speed, causing damage to the seals, bucket covers and tenons.

Means is shown in my U.S. Pat. No. 5,271,712, utilizing a small circumferential opening in the tip seal in conjunction with a scoop to encourage the particles to be discharged from the tip seal area by deflecting them through the small opening. The scoop of U.S. Pat. No. 5,271,721 is an integral part of the tip seal. Consequently, it is limited in application to those tip seals with sufficient mass and strength to hold the scoop in place in spite of particle impacts and large, time varying steam forces.

The scoop, being integral with the tip seal must generally be made of the same material as the tip seal. This is often a handicap since the tip seal material is selected to be capable of rubbing away with a minimum of damage to adjacent rotating parts such as the bucket covers. The scoop, on the other hand, should ideally be made of material resistant to erosion and impact loads.

SUMMARY OF THE INVENTION

It is the purpose of the invention to provide tip seal scoops of improved geometry and/or material permitting the application of the scoops to a wider range of tip seal designs, including J-strips and inserted tip seals.

DESCRIPTION OF THE PREFERRED EMBODIMENT

Figure 1:
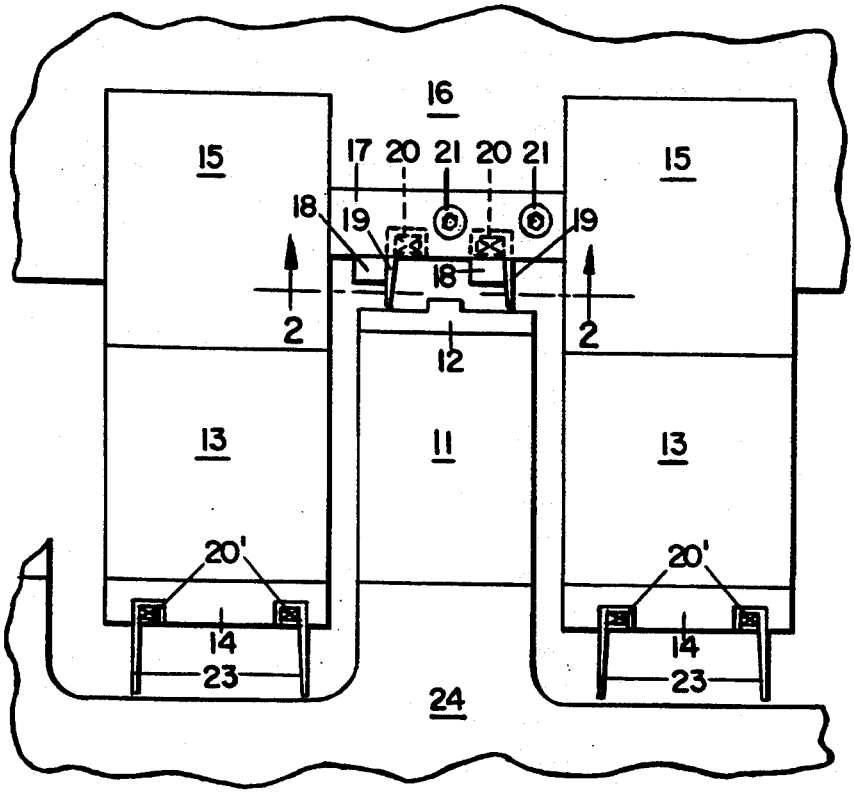
FIG. 1 is a fragmentary view looking downwardly at the parting line of a typical turbine stage showing a preferred form of tip seal protection means embodying the invention.

FIG. 1 is a fragmentary cross sectional view of a portion of a typical turbine stage as seen at the horizontal joint of the turbine.

A rotatable shaft or rotor 24 holds rows of buckets 11, only one of which is shown, each bucket having a shroud or bucket cover 12 fixed thereto.

Stationary nozzles 13 disposed on either side of bucket 11 have an outer solid portion 15 fixed in a spill strip holder or shell 16.

Spaced shroud or tip seals 19 are mounted on and depend from a portion of shell or spill strip holder 16 which extends between outer portions 15 of adjacent nozzles 13.

Tip seals 19 overlie shroud or bucket cover 12 and are so located as to minimize steam leakage over shroud 12.

Tip seals 19 may be in the form of inverted J-strips as shown, or may be in the form of teeth inserted into the shell and are held in place by such as compressed locking rings 20, although other means may be employed.

An expulsion scoop 18 is mounted on and depends from plate 17 adjacent each tip seal 19 and is so positioned as to deflect particles which are moving circumferentially adjacent the upstream side of the tip seals causing the particles to pass through a small circumferential opening, not shown, in the tip seals and to move downstream.

Figure 3:
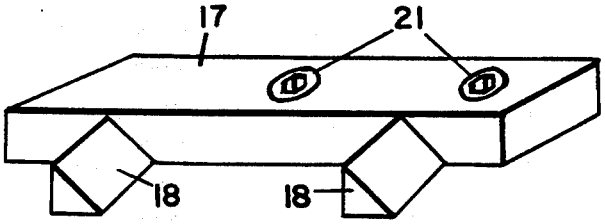
FIG. 3 is a front perspective view of the expulsion scoop plate of the tip seal damage protection means of the invention.
Figure 4:
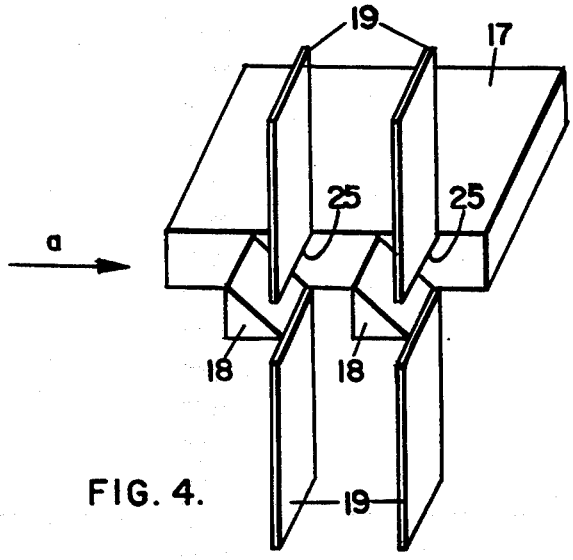
FIG. 4 is a schematic front perspective view showing the relationship between the expulsion scoop plate, expulsion scoop and tip seals embodying the invention.

As best seen in FIGS. 3 and 4, expulsion scoops 18 are triangulate in elevation so as to guide any particulate material flowing downstream in the direction of arrow a through provided openings 25 in tip seals 19, to avoid damage to the tip seals.

Root seals 23 are mounted in and depend from an inner ring portion 14 of stationary nozzles 13 and minimize leakage between the nozzles and rotatable shaft or rotor 24.

Root seals 23 are held in place by such as compressed locking rings 20', although other means may be employed.

Figure 2:
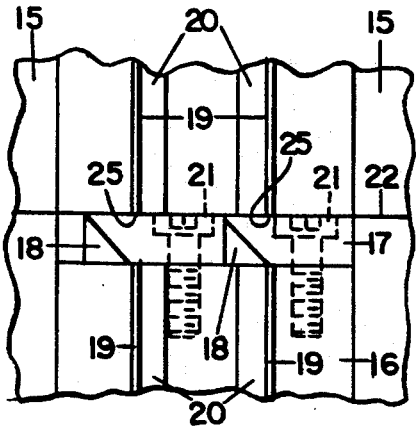
FIG. 2 is a radial view taken on line 2—2 of FIG. 1.

FIG. 2 is a radial view of the turbine stage taken on line 2—2 of FIG. 1 at a horizontal joint 22. Shroud or tip seals 19 are shown as extending in both directions from joint 22, except that a small portion of the shroud or tip seal is cut away as at 25, just below joint 22. Scoop plate 17 is mounted on a provided cut-out portion of holder 16, immediately below joint 22. The scoop plate is secured in this location as by bolts 21 and is further held in place by the pressure of the upper half of holder 16 which is held tightly against the lower half of the holder in which the scoop plate is mounted.

Expulsion scoops 18 extend from scoop plate 17 radially into the area upstream of tip seals 19 so as to direct particles through the opening in the tip seals at 25.

FIG. 3 is a perspective showing of scoop plate 17 and expulsion scoops 18.

In operation, expulsion scoops 18 greatly reduce the period of time spent by particles adjacent the tip seals and shrouds, thus minimizing the damage caused by the particles.

Scoop plate 17 provides a solid base for locking of the expulsion scoops whereas the tip seals themselves could not provide such locking should the scoops be mounted on the tip seals themselves.

Expulsion scoops 18 should preferably be fabricated from a material resistant to erosion and damage such as oxidation and corrosion, with excellent toughness, high temperature strength, hardenability and with a thermal coefficient of expansion close to Ferritic stainless steel, such as AISI Series 400 stainless steel. To further increase the security of scoop plate 17 the material from which it is fabricated should advantageously have a slightly greater thermal expansion coefficient than that of holder 16.

I claim:

1. In a steam or gas turbine employing tip seals which are disposed between a stationary shell or spill strip holder and a rotating bucket cover or shroud to minimize steam leakage, the improvement for limiting particulate damage to the tip seals and adjacent components comprising:

a scoop plate mounted on the shell or spill strip holder from which the tip seals depend, circumferential openings in the tip seals, and expulsion scoops on the scoop plate adjacent the tip seals for deflecting particulate material through the circumferential openings in the tip seals for minimizing damage thereto.

2. In a steam or gas turbine according to claim 1, wherein the expulsion scoops are triangulate in shape.

3. In a steam or gas turbine according to claim 1, wherein the scoop plate is fabricated from a material having a higher thermal coefficient of expansion than the shell or spill strip holder.

4. In a steam or gas turbine according to claim 1, wherein the expulsion scoops are fabricated from a material strongly resistant to erosion and oxidation with excellent toughness, high temperature strength, hardenability and with a thermal coefficient of expansion close to Ferritic stainless steel.

5. In a steam or gas turbine according to claim 4, wherein the expulsion scoops are fabricated from AISI series 400 stainless steel.

* * * * *